US011685881B2

(12) United States Patent
Al-Bayati et al.

(10) Patent No.: US 11,685,881 B2
(45) Date of Patent: Jun. 27, 2023

(54) ELECTROLYTIC SYSTEM FOR AUTOMATIC DISHWASHING

(71) Applicant: Reckitt Benckiser Finish B.V., Hoofddorp (NL)

(72) Inventors: Alias Younis Al-Bayati, Heidelberg (DE); Callum Couser, Heidelberg (DE); Gerhard Kammerer, Heidelberg (DE); Jorg Peter Pflug, Heidelberg (DE)

(73) Assignee: Reckitt Benckiser Finish B.V., Hoofddorp (NL)

( * ) Notice: Subject to any disclaimer, the term of this patent is extended or adjusted under 35 U.S.C. 154(b) by 0 days.

(21) Appl. No.: 16/464,800

(22) PCT Filed: Nov. 28, 2017

(86) PCT No.: PCT/EP2017/080635
§ 371 (c)(1),
(2) Date: May 29, 2019

(87) PCT Pub. No.: WO2018/099903
PCT Pub. Date: Jun. 7, 2018

(65) Prior Publication Data

US 2019/0313879 A1 Oct. 17, 2019

(30) Foreign Application Priority Data

Dec. 2, 2016 (GB) ..... 1620479

(51) Int. Cl.

| | |
|---|---|
| ***A47L 15/00*** | (2006.01) |
| ***C11D 11/00*** | (2006.01) |
| ***A47L 15/42*** | (2006.01) |
| ***C11D 3/386*** | (2006.01) |
| ***C11D 3/395*** | (2006.01) |
| ***C25B 1/34*** | (2006.01) |
| ***C25B 9/17*** | (2021.01) |

(52) U.S. Cl.
CPC ..... *C11D 11/0023* (2013.01); *A47L 15/0007* (2013.01); *A47L 15/0015* (2013.01); *A47L 15/0055* (2013.01); *A47L 15/4238* (2013.01); *C11D 3/386* (2013.01); *C11D 3/3953* (2013.01); *C25B 1/34* (2013.01); *C25B 9/17* (2021.01); *A47L 2601/03* (2013.01); *A47L 2601/06* (2013.01)

(58) Field of Classification Search
CPC ..... A47L 15/4238; A47L 15/0007; A47L 15/0015; A47L 15/0055; A47L 2601/03; A47L 2601/06; C11D 3/386; C11D 3/3953; C11D 11/0023
See application file for complete search history.

(56) References Cited

U.S. PATENT DOCUMENTS

| | | | | |
|---|---|---|---|---|
| 5,807,438 | A | 9/1998 | Lansbergen et al. | |
| 2003/0109398 | A1* | 6/2003 | Yoneda | C11D 3/10 510/276 |
| 2003/0213503 | A1 | 11/2003 | Price et al. | |
| 2003/0213505 | A1* | 11/2003 | Price | C11D 17/003 206/524.1 |
| 2003/0216271 | A1 | 11/2003 | Scheper et al. | |
| 2013/0056364 | A1 | 3/2013 | Stecker et al. | |
| 2014/0143959 | A1* | 5/2014 | Job | C11D 3/28 8/137 |
| 2017/0037342 | A1* | 2/2017 | Spill | C11D 3/28 |
| 2019/0313879 | A1* | 10/2019 | Al-Bayati | A47L 15/0015 |

FOREIGN PATENT DOCUMENTS

| | | | |
|---|---|---|---|
| CH | 634217 | A5 | 1/1983 |
| DE | 102006037905 | A1 | 2/2008 |
| RU | 2007118655 | A | 10/2005 |
| WO | 2006044951 | A2 | 4/2006 |
| WO | 2016020680 | A1 | 2/2016 |

OTHER PUBLICATIONS

European Search and Examination Report issued in GB1620479.4 dated May 23, 2017.
International Search Report and Written Opinion issued in PCT/EP2017/080635 dated Feb. 15, 2018.

* cited by examiner

*Primary Examiner* — Sharidan Carrillo
(74) *Attorney, Agent, or Firm* — Troutman Pepper Hamilton Sanders LLP; Ryan A. Schneider; Chris N. Davis

(57) ABSTRACT

A method of automatic dishwashing of dishware, including electrolytically generating a bleaching species, washing the dishware with a composition comprising the bleaching species, and washing the dishware with a composition including an enzyme. The invention also includes an automatic dishwasher including a wash tank, an electrochemical cell, and a first reservoir containing a composition including an enzyme, wherein the electrochemical cell contains a solution including an alkali metal chloride salt, wherein the dishwasher is configured to electrolyze the solution, and to dose the electrolyzed solution into the wash tank before dosing the composition including the enzyme into the wash tank. The invention also includes a kit for use in the method of automatic dishwashing of dishware.

4 Claims, No Drawings

ELECTROLYTIC SYSTEM FOR AUTOMATIC DISHWASHING

TECHNICAL FIELD

The present invention is in the field of automatic dishwashers. In particular, it relates to an automatic dishwasher offering excellent and easily tailorable performance whilst also being energy-efficient.

BACKGROUND

Enzymes such as protease and amylase, and bleaches such as sodium percarbonate and sodium perborate, are important ingredients of many commercially available automatic dishwashing detergents. Typically they are provided in the detergent in a predetermined amount together with all the other detergent ingredients, so they are released into the wash at the same time even though they reach their optimum activity at different temperatures. For instance, most conventional bleaches used in automatic dishwashing only exhibit a satisfactory activity at around 50° C. or above, even when bleach activators and/or catalysts are used to enhance their performance. Many enzymes, on the other hand, can function well at lower temperatures.

On occasions, the separate dosing of enzymes and bleach has been discussed, but most commonly it has been thought that the enzymes should be dosed first and the bleach subsequently, to avoid deactivation of the enzymes by the bleach. Conversely, WO 2016/020680 discloses an innovative system in which the main wash starts with a moderately high temperature bleaching solution and is later followed by use of enzymatic solution at a lower temperature. It would be advantageous to further reduce energy consumption associated with the generation of sufficiently hot water for the bleaching step, without compromising on the bleach performance or generating species which cause issues for the subsequent enzymatic wash stage. In addition, in the context of the system of WO 2016/020680, in which detergent should be stored inside the machine and dosed over multiple wash cycles, the storage stability of the detergent is especially important.

Liquids are typically easier to dose in a multi-dose system and give good flexibility over the amount that can be dosed each time. However, although some chlorine bleaches are more active than oxygen bleaches under low temperature conditions, commercially available liquid solutions of chlorine bleach such as sodium hypochlorite are not especially stable upon storage in a dishwasher. They should be stored in a dry, cool and well-ventilated area, which is the opposite of the conditions inside a dishwasher. They can also present dangers such as skin burns if a consumer comes into contact with them, can generate chlorine gas upon decomposition, and can deactivate enzymes.

EP 2,380,481 discloses an automatic dosing device which delivers a first composition which is a solid comprising sodium dichloroisocyanurate (NaDCC) at the beginning of the main wash cycle, and a second composition comprising enzymes and a bleach scavenger five minutes later. However, the bleaching effect achieved using NaDCC for such a short period of time is not especially high, the requirement for a bleach scavenger is inconvenient but the enzymes are not sufficiently protected without it, and it is difficult to vary the amount dosed from wash to wash.

The appropriate balance must be struck between a bleaching species which gives high bleaching performance and can become effective very quickly during the wash (so as not to unduly prolong the wash cycle), yet is energy-efficient and storage stable, does not cause issues for the subsequent enzymatic wash stage, and can be dosed in a liquid form without presenting hazards to the consumer.

SUMMARY OF THE INVENTION

In a first aspect of the invention there is provided a method of automatic dishwashing of dishware, comprising electrolytically generating a bleaching species, washing the dishware with a composition comprising said bleaching species, and afterwards washing the dishware with a composition comprising an enzyme.

In a second aspect of the invention there is provided an automatic dishwasher comprising a wash tank, an electrochemical cell and a first reservoir containing a composition comprising an enzyme, wherein the electrochemical cell contains a solution comprising an alkali metal chloride salt, wherein the dishwasher is configured to electrolyse the solution and to dose the electrolysed solution into the wash tank before dosing the composition comprising the enzyme into the wash tank.

In a third aspect of the invention there is provided a kit of:

- an automatic dishwasher comprising a wash tank, an electrochemical cell and a first interface; and
- at least a first cartridge which is adapted to mate with the first interface, wherein the first cartridge comprises a first reservoir containing a composition comprising an enzyme;
  - wherein the kit comprises a second reservoir containing a composition comprising an alkali metal chloride salt, wherein the second reservoir is provided either inside the first cartridge or in a second cartridge which is adapted to mate with the first interface or a second interface on the dishwasher;
  - wherein, when the first cartridge and the second cartridge, if present, are mated with the respective interface, the dishwasher is configured:
    - to feed the composition comprising the alkali metal chloride salt, or a solution of said composition, from the second reservoir into the electrochemical cell;
    - to electrolytically generate a bleaching species; and
    - to feed the electrolytically generated bleaching species into the wash tank and afterwards to feed the composition comprising the enzyme into the wash tank.

DETAILED DESCRIPTION

All percentages mentioned herein are % by weight unless otherwise stated or the context otherwise requires. Embodiments described herein in relation to one aspect of the invention apply equally to other aspects of the invention unless specified to the contrary or the context otherwise requires.

In an embodiment of the invention, the bleaching species is generated by a method comprising electrolysing a solution of an alkali metal chloride salt, preferably sodium chloride.

The electrolysis of sodium chloride solution (brine) to produce bleach is itself a well-known reaction. Hydrogen gas is produced at the cathode and chlorine gas at the anode; provided the chlorine gas is not allowed to escape, it dissolves and reacts further to produce sodium hypochlorite or hypochlorous acid, depending on the pH.

The inventors have studied this system and found that bleach can be generated relatively quickly, in-situ in a dishwasher and in an appropriately small volume of water, for immediate use during the washing cycle or for storage for later use. They concluded that electrolysis under alkaline pH is best suited to the present invention, to generate the bleaching species sufficiently quickly for the desired dishwasher wash program and to avoid adversely affecting the later enzymatic step.

Thus, in an embodiment, the solution which is electrolysed is alkaline, preferably having a pH of: at least 8, at least 8.5, at least 8.6, at least 8.7, at least 8.8, at least 8.9, or at least 9; and/or up to 10, up to 9.5, up to 9.4, up to 9.3, up to 9.2, or up to 9.1. Preferably, the electrolysed solution does not undergo further pH modification before being supplied to the wash water. The solution may be buffered or unbuffered.

The solution which is electrolysed may be a solution of the alkali metal chloride salt in deionized water or non-deionized water. In an embodiment, deionized water is used. In an embodiment, the solution contains no other active ingredients; in an embodiment it consists essentially of, or consists of, water and the alkali metal chloride salt.

The electrolysis reaction does not require a high temperature to proceed. Thus, lower temperatures can be used to conserve energy. In an embodiment, the inventive method comprises electrolytically generating the bleaching species at a temperature no higher than 40° C., preferably no higher than 35, 30 or 25° C.

In an embodiment, the electrochemical cell is located inside a main housing of the dishwasher. In an embodiment, sodium chloride is present in a salt tank of the dishwasher and additionally used to replenish the electrochemical cell. In an embodiment, the electrochemical cell is unvented or otherwise adapted such that any chlorine gas generated during the reaction does not escape from the cell, but rather dissolves back into solution.

Preferably the electrochemical cell is supplied with DC current from the dishwasher, and no additional battery is required. This places its own design constraints on the electrolysis conditions that can be used, if there is not a completely free choice of voltage.

In an embodiment, the voltage of the electrochemical cell is 8-10 V, preferably 8.5-9.5 V, preferably 8.9-9.1 V, preferably 9 V. In another embodiment, a higher voltage may be chosen.

In an embodiment, the dishwasher is configured to be able to tune the voltage supplied to the electrochemical cell. This provides additional control over the reaction to be able to tailor it to different wash programs e.g. produce the bleaching species more quickly for a quick wash program, or in a more concentrated form for an intensive wash program.

In an embodiment, there is no membrane or other physical separator between the electrodes of the electrolysis cell. Preferably, the solution supplied to the anode is of the same constitution as the solution supplied to the cathode. Preferably, a single solution is supplied to the electrolysis cell and each electrode is in contact with the single solution.

Preferably the electrodes are made of any suitable material that resists corrosion in the alkaline solution.

In an embodiment, the volume of solution that is electrolysed each time is less than 1 litre, preferably: up to 800 ml, up to 700 ml, up to 600 ml, up to 500 ml, up to 400 ml, up to 300 ml, up to 250 ml, or up to 200 ml; and/or at least 50 ml, at least 100 ml, or at least 150 ml.

In some circumstances the best yield of bleaching species is obtained by electrolysing a fairly small volume of relatively concentrated solution, whereas the hydraulics of the dishwasher require a larger volume of liquid for effective supply to the wash tank. Accordingly, the electrolysed solution may be diluted before being supplied to the wash tank. In an embodiment, the volume of solution comprising the bleaching species that is supplied to the wash tank of the dishwasher is less than 1 litre, preferably: up to 800 ml, up to 700 ml, up to 600 ml, up to 550 ml, or up to 500 ml; and/or at least 100 ml, at least 150 ml, at least 200 ml, at least 250 ml, or at least 300 ml.

In an embodiment, the concentration of the alkali metal salt in the solution is: at least 1 wt %, at least 2 wt %, at least 5 wt %, preferably at least 10 wt %, preferably at least 15 wt %, preferably at least 20 wt %, preferably at least 25 wt %; and/or up to 40 wt %, preferably up to 35 wt %, preferably up to 30 wt %.

In an embodiment, the electrolysis reaction proceeds for: at least 5 min, preferably at least 10 min, preferably at least 15 min, preferably at least 20 min, preferably at least 25 min, preferably at least 30 min, preferably at least 35 min, preferably at least 40 min; and/or up to 60 min, preferably up to 55 min, preferably up to 50 min, preferably up to 45 min. If this is too long in the context of the desired wash program of the dishwasher, the electrolysis reaction can proceed in advance and the generated bleaching species stored for use in a later wash cycle.

The enzyme may be any enzyme that is suitable for use in automatic dishwashing. Preferably it is an amylase or a protease. The enzyme-containing composition may comprise both an amylase and a protease.

The dishwasher of the invention is preferably a domestic dishwasher. Preferably it has a single wash tank and it is of non-conveyor type, i.e. the dishes remain stationary inside the dishwasher. Preferably the wash program lasts: at least 15 min, at least 20 min, at least 25 min, at least 30 min, at least 35 min, at least 40 min, or at least 45 min; and/or up to 90 min, up to 80 min, up to 70 min, or up to 60 min.

The enzyme-comprising composition may be added to a reservoir found inside the dishwasher itself. Alternatively it may be supplied from a cartridge which mates with the dishwasher. Similarly, the composition comprising the alkali metal salt may be stored in a reservoir inside the dishwasher or inside a cartridge which mates with the dishwasher, either the same cartridge as the enzyme-comprising composition or a different one.

Advantageously, the salt tank of the dishwasher is used for the dual purpose of its normal function and to replenish the electrochemical cell.

In an embodiment, the electrolytically generated bleaching species is supplied during a main wash phase of the dishwasher cycle. Preferably, the enzyme is supplied later in the same main wash phase. In an embodiment, the dishwasher cycle comprises a rinse phase after supply of the electrolytically generated bleaching species and before supply of the enzyme.

Examples

The following non-limiting examples provide a proof of principle of the present invention.

310 ml of a 2.86% (w/w) NaCl solution at pH 9-10 was prepared using NaCl, NaOH and deionized water. This was electrolysed at room temperature with a voltage of 9V and current of 1.5 A for 2 hours. There was no ion permeable membrane or other separator between the electrodes. The resulting solution was diluted with deionized water to a 500 ml volume.

A Miele G661 dishwasher was loaded with soiled dishes which were washed according to the following model procedure, using the electrolytically-generated bleach at room temperature in Example 1 and conventional bleach at 50° C.

in Comparative Example 1. The washed dishes were assessed according to the IKW method (10=cleanest, 1=dirtiest).

| Step | Volume (ml) | Time (min) | Example 1 | Comparative Example 1 |
|---|---|---|---|---|
| Bleaching step#* | 500 | 2 | Aqueous solution of chlorine bleach, room temperature | Aqueous solution of percarbonate bleach, 50° C. |
| Additional rinse#* | 4 × 500 | 2 | Water | Water |
| Ballast soil added | | | | |
| Enzymatic step## | 3700 | 20 | Composition with amylase & protease, 40° C. | |
| Rinse steps, non-ionic surfactant & water, 70° C. | | | | |
| IKW score - bleachable stains (tea) | | | 9.7 | 10.0 |
| IKW score - burnt-on milk | | | 7.1 | 7.0 |
| IKW score - egg yolk/minced meat | | | 8.0 | 8.5 |
| IKW score - dried-on starch | | | 8.2 | 9.1 |
| Average score | | | 8.3 | 8.7 |

#sprayed manually

*washing liquor drained from the tank subsequently sprayed via the machine spray arm

It can be seen from these results that the inventive process (using electrolytically-generated bleach) achieves excellent performance at much lower temperature and still gives acceptable enzyme performance in the subsequent step.

In this test, the electrodes were already somewhat corroded before being used, causing the reaction to proceed more slowly than desired. It is expected that with fresh, uncorroded electrodes, the reaction would proceed much faster. In addition, the undiluted chlorine bleach-containing solution was found to be stable for at least 7 days when stored in closed glass bottles either in the fridge or at room temperature. This provides the convenience of being able to generate a batch of electrolysed solution in advance of the start of the normal dishwasher wash program, so fast washes can be maintained even in the circumstance when the electrolysis reaction is not as fast as desired.

The invention claimed is:

1. A method of automatic dishwashing of dishware comprising a bleaching step and a subsequent enzymatic step, wherein the bleaching step consists of:

providing an electrochemical cell;

a step of electrolytically generating a bleaching species by electrolyzing a solution in the electrochemical cell, wherein the solution consists of sodium chloride, sodium hydroxide, and water at a concentration ranging from at least 2 wt % up to 40 wt %, at a temperature no higher than 40° C., the solution being alkaline and having a pH in a range from 8-10; and washing the dishware with the electrolyzed solution; and the subsequent enzymatic step comprising:

washing the dishware with a a bleach free composition comprising an enzyme comprising one or both of an amylase and a protease.

2. The method according to claim 1, wherein the electrochemical cell has no membrane separating electrodes therein.

3. The method according to claim 1, wherein the step of electrolytically generating the bleaching species is performed at a temperature no higher than 25° C.

4. The method according to claim 1, further comprising a step of rinsing the dishware subsequent to the bleaching step.

* * * * *